US005833120A

United States Patent [19]

Evans, Sr. et al.

[11] Patent Number: 5,833,120

[45] Date of Patent: Nov. 10, 1998

[54] INVERTED BAG CHEESE SERVER

[75] Inventors: John C. Evans, Sr.; James G. Potter, both of Cincinnati, Ohio

[73] Assignee: Gold Medal Products Co., Cincinnati, Ohio

[21] Appl. No.: 734,108

[22] Filed: Oct. 21, 1996

[51] Int. Cl.[6] ..... B65D 35/28

[52] U.S. Cl. ..... 222/95; 222/105; 222/111; 222/135; 222/146.4; 222/181.2; 222/1

[58] Field of Search ..... 222/95, 92, 105, 222/107, 111, 129, 135, 146.4, 146.5, 181.2, 102, 103, 1

[56] References Cited

U.S. PATENT DOCUMENTS

| | | | |
|---|---|---|---|
| 2,905,560 | 9/1959 | Bender et al. | 222/105 X |
| 3,945,534 | 3/1976 | Ady | 222/105 |
| 4,418,840 | 12/1983 | Gardner, Sr. | 222/102 X |
| 4,544,085 | 10/1985 | Frazer | 222/146.4 |
| 4,639,251 | 1/1987 | Kirkland | 222/102 X |
| 4,690,307 | 9/1987 | Hogan | 222/105 X |
| 4,899,908 | 2/1990 | Kardiak | 222/146.5 X |
| 5,102,015 | 4/1992 | Barnard et al. | 222/146.5 X |
| 5,676,279 | 10/1997 | Bastion | 222/102 X |

*Primary Examiner*—Kenneth Bomberg
*Attorney, Agent, or Firm*—Wood, Herron & Evans, LLP

[57] ABSTRACT

A cheese server includes hangers for engaging cheese bag bottoms and suspending the bags inverted in a steam chamber. Gravity influenced squeeze bars ride down the bag sides to express cheese toward the bag outlet fitment. A hose is connected to the fitment and is pinched off by an "iron udder" clamping apparatus to control dispensing. Water in the bottom of the steam tank is heated to produce steam for heating the cheese quickly. A trough in the chamber top returns condensate to the water.

14 Claims, 2 Drawing Sheets

INVERTED BAG CHEESE SERVER

This invention relates to apparatus and methods for dispensing viscous materials and more particularly for warming and dispensing cheese.

This application is related to the commonly owned application entitled "CHEESE SERVER" by Lee Hodgson filed on even date herewith.

In the food service industry, it is desirable to warm cheese to a hot serving temperature and to dispense it for consumption, for example, on nacho chips or other foods. Where cheese is supplied in flexible bags, it must be warmed and somehow dispensed from the bags. In the past, cheese warmers have included an air-warmed cabinet and a heated platen. Bags are placed on the platen and are heated by the air and the platen.

Such systems are subject to numerous drawbacks. First, it is desired to serve cheese at about 140°–150° F. A large bag containing several pounds of cheese is difficult to heat up this range from room temperature or particularly from lower refrigerated temperatures in a short time period. The bag material, for example, might start to disintegrate when heated above 160° F., particularly when engaged by a platen at that or hotter temperatures. Thus platens at 160° F. or greater tend to burn or scorch the bags. On the other hand, the transfer of heat to the cheese in the bags by hot air convection is a very slow process. Accordingly, when a cheese bag is removed from a cool storage environment, prior devices require extensive warm up or lead times before cheese is ready for service.

Moreover, regulatory authorities are now requiring, in such cheese service operations, that when the cheese bag has been opened, then refrigerated for storage, it must be heated to 160° F., then cooled to a service temperature, such as 140° F., all within a two-hour time period. The nature of the bags and their sensitivity to high platen temperatures, and the difficulty in quickly transferring heat by air convection make it difficult for known devices to meet these parameters.

Another consideration in cheese service is the waste, or the cheese left remaining in the bag which cannot be dispensed. It is not unusual to have ten percent or more of the bag's content left over and which cannot be dispensed, resulting in significant expense.

Accordingly, it has been one objective of the invention to provide apparatus and methods for warming and dispensing cheese from bags more quickly and efficiently than in the past.

Another objective of the invention has been to provide improved apparatus and methods for heating cheese in a bag from a refrigerated state to above a serving temperature and for dispensing cheese at a serving temperature from said bags, all within two hours from removing the bag from a refrigerator.

To these ends, a preferred embodiment of the invention includes a steam tank in which cheese bags are hung from their bottoms, their outlet fitments being the lowest portion of the bags. A hose is connected to the fitment and extends outside the tank for dispensing cheese under the control of a so-called "iron udder" clamping apparatus. A pair of squeeze rods, connected at their ends, are disposed over the bag bottom, one rod on each side of the bag. As the cheese is dispensed, the rods slide down the bag sides, pressing them together and expressing the cheese toward the bag bottom and the fitment or outlet.

The bags are supported in an inverted position by placing the bottom seam in a channel and locking it in place with a clip or lock rod after the pair of squeeze rods are placed over the bag.

Water is placed in the bottom of the tank and is heated to generate steam for warming the cheese. A baffle is disposed in the tank and has inclined sides supporting the cheese bag and fitment above the water level, and at the same time urging the bag corners inwardly so cheese tends to flow out of the corners to the center of the bag at the outlet fitment.

A cover is provided over the steam tank and the tank is provided with a condensate trough about its upper periphery for directing condensate back into the water. The cover edges lie in the trough so condensate is routed into the trough and back to the tank.

Water in the tank is heated by a heater plate under the tank and supporting one or more heater strips sufficient to boil the water to generate steam. The heater strips are thermostat controlled.

In this manner, the water is quickly heated and the steam quickly heats the cheese. The bags are protected by the cheese therein so that exposure to the hot steam does not scorch or disintegrate the bags, yet the cheese is heated quickly.

The cheese bags used in such inventions are of any suitable size and preferably about 12"×12" square and about 2" thick when full. They contain about 106 ounces of cheese. When such a bag has been opened but only partially used before the serving operation is discontinued, it must be refrigerated. When thereafter used, regulations require "rethermalization" where the cheese must be raised to 160° F., then reduced to serving temperatures of 140° to 150° F., all within two hours. The server disclosed herein is capable of meeting that parameter.

Accordingly, these and other objectives and advantages will be readily appreciated from the following detailed description of a preferred embodiment and from the drawings in which.

Figure 1:
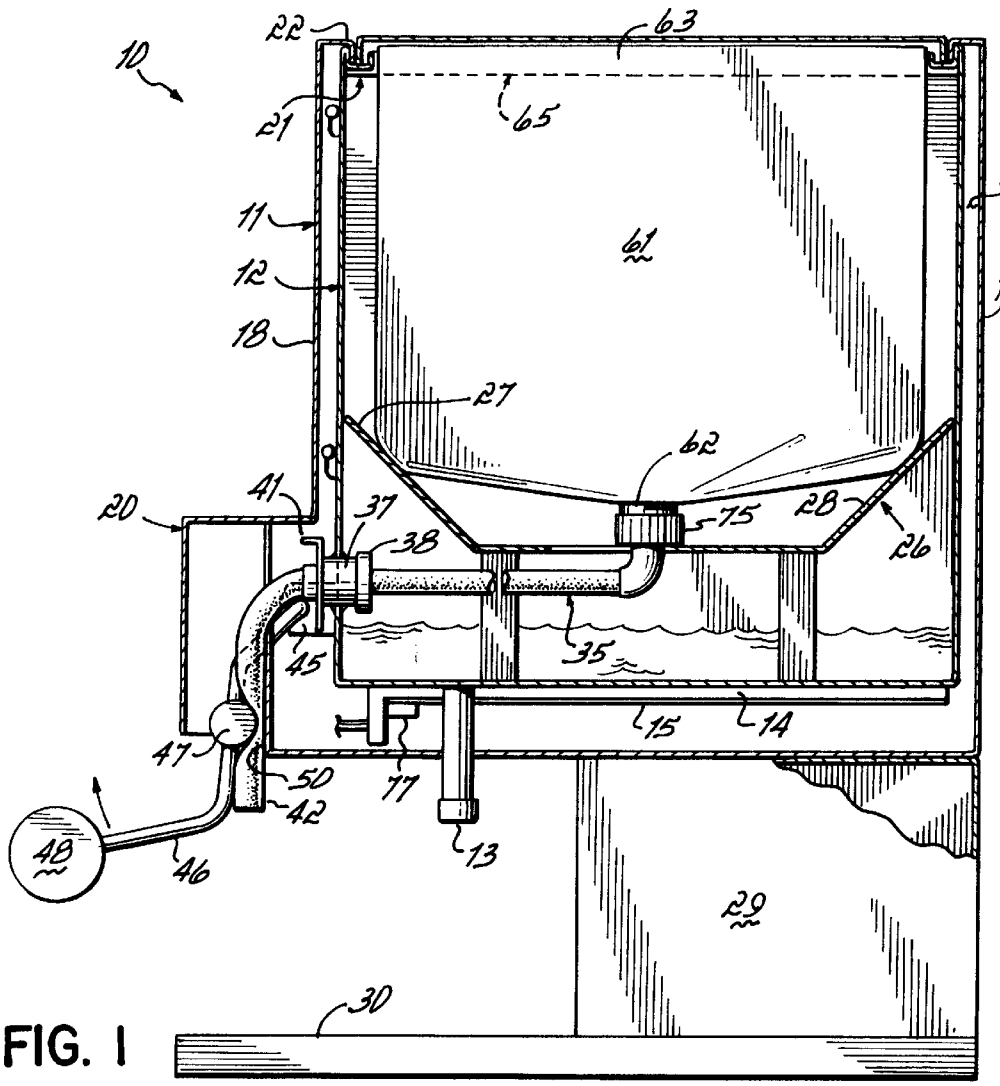
FIG. 1 is a sidwview in partial cross-sectional view of a preferred embodiment of the invention.

Turning now to the drawings, there is shown in FIG. 1 a cheese server 10 according to a preferred embodiment of the invention. The server 10 comprises a cabinet 11 and a water or steam tank 12 provided with a drain 13. A heat plate 14 is disposed under the tank 12 and is provided with thermostatically controlled strip heaters 15 of any suitable type.

The cabinet 11 includes side panels 16, 17, front panel 18 and a rear panel 19.

Figure 4:
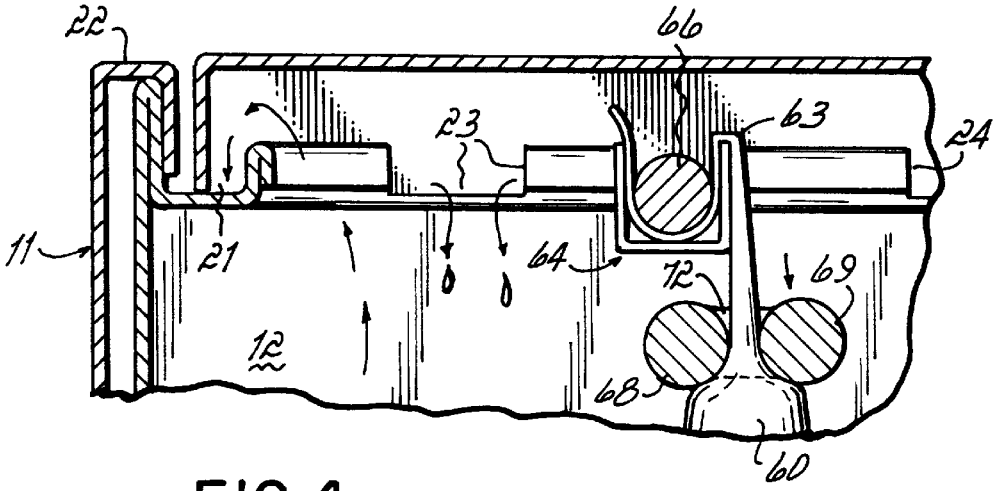
FIG. 4 is a typical cross-sectional view of the upper edge of the steam tank, cabinet, cover and bag.

As perhaps best illustrated in FIG. 4, the tank 12 is provided at its top end with a trough 21. The upper edges of the cabinet panels 16–19 are bent, as at 22, so that their upper edges are bent over into and reside in the trough 21. The trough 21 is illustrated in FIG. 4 as a plurality of cut-outs 23, 24 for example, for the purpose of permitting condensate to fall back into the interior of the tank 12. Inside the tank 12 is located a baffle 26. Baffle 26 has inclined sides 27, 28, as will be further described.

The front panel 18 has an enlarged projection 20 thereon fitting over the lower front area of the cabinet 11 to accommodate the dispensing hose and valve or clamp mechanism as will be described. The cabinet is mounted by means of an enclosure as at 29, above a support plate 30.

It will be appreciated that a flexible hose or conduit 35 extends from the central area of the steam tank through the lower wall 36 of the tank 12. This is perhaps best seen in FIG. 3, where the lower wall 36 of the steam tank 12 is provided with a pipe 37 welded to an aperture through the wall 36.

A flanged fitting 38 extends through the pipe and is sealed thereto by means of a "V"-ring seal 39, which can be made of any suitable flex material sufficient to withstand the steam heat.

Figure 3:
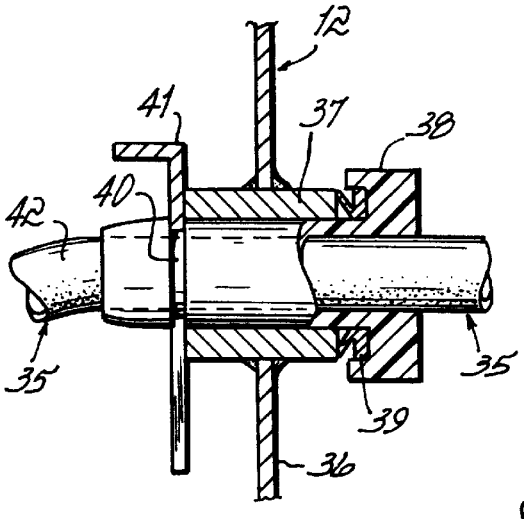
FIG. 3 is an enlarged view of the cheese dispenser hose and its transfer through the steam tank wall.

A groove 40 is provided in the outer end of the fitting 38 and once extended through the pipe 37, a clip 41 is fit over the fitting 38 into groove 40 to retain the fitting in position. The hose 35 extends through the fitting 38 in a static condition and in a sliding relationship. Thereafter the outer end of the hose 35 comprises a dispensing end 42 which hangs downwardly as shown in FIG. 3.

Returning now to FIGS. 1, 2 and 3, an "iron udder" pinching or clamping mechanism is utilized to selectively pinch off and open the hose for dispensing of warm cheese. This mechanism includes a pivot block 45, crank arm 46, pinch member 47 and weight 48. The pinch member and the weight are mounted on the crank arm 46 as shown in the figures.

Once the hose exits the tank through the fitting 38, it hangs downwardly against a front face 50 of the cabinet 11, generally under the enlargement 20 of the front cabinet panel 18. The pinching member 47 is on the other side of the hose from the surface or front face 50, so that when the weight rests in the position in FIG. 1, the pinch member 47 is urged to pinch off the hose at its dispensing end 42 against the face 50.

When it is desired to dispense cheese, the weight is manually lifted, removing the pinch member 47 from the hose 42 and allowing the cheese to flow. The cheese warmer and server described is particularly useful for the dispensing of heated or warmed cheese from flexible bags such as bags 60, 61.

These bags generally comprise bags of 12"×12" in rectangular shape and about 2 inches thick. The bags are provided with a fitment 62 having external threads and a cap (not shown) for sealing the contents of the bag prior to use. Other sized or shaped bags might be used as well with any necessary structural modifications to accommodate them.

Each of the bags has what is referred to as a bottom end, that is an end or portion of the bag which is opposite the outer fitment 62. Thus, the portion 63 of the bag is opposite the outlet which is defined by the fitment 62. The bag is generally square yet, when utilized in connection with the invention and lowered into the steam tank 12, the lower corners of the bag are engaged by the inclined surfaces 27 and 28 of the baffle 26. As hung, portion 63 will be in the upper region of the bag and fitment 62 in the lower region.

As the bag is lowered into the tank 12, the corners are urged inwardly to thereby urge cheese in the bag toward the center outlet or fitment 62. The bags are supported in the steam chamber, or tank 12, by securing them at their end portions 63 as will now be described.

Figure 2:
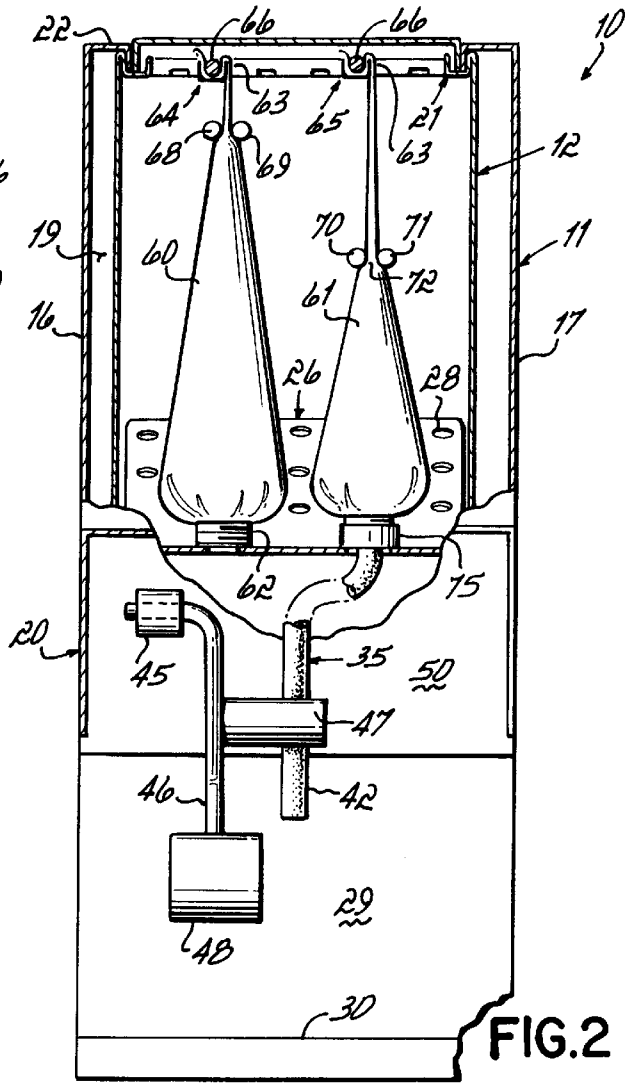
FIG. 2 is a front view in partial cross-section of the invention of FIG. 1 in partial cross-section.

In this regard, hangers 64, 65 are provided for spanning the upper opening of the steam tank 12 (FIG. 2). These hangers comprise "TC"-shaped channels which generally open upwardly. The portion 63 of the bag is forced into the channel and a locking rod 66 is forced down against the bag portion 63, thus urging the bag portion on both sides of the locking rod 66 against opposite flanges of the "C"-shaped channel. This locks the bag in place and the hangers can be used to then suspend the bags over the steam chamber 12, the ends of the hangers resting on the front and back edges of the steam chamber.

It will be appreciated that other forms and types of hangers for holding the bag in an inverted fashion as shown could be effectively utilized. For example, the bag could be rolled on a rod, clipped to a support or otherwise hung.

Prior to securing the bag on the hangers 64, 65, however, apparatus for urging cheese out of the bag is first fitted on the bag. This apparatus comprises a pair of rods, such as rods 68, 69 on bag 60 and rods 70, 71 on bag 61.

Figure 5:
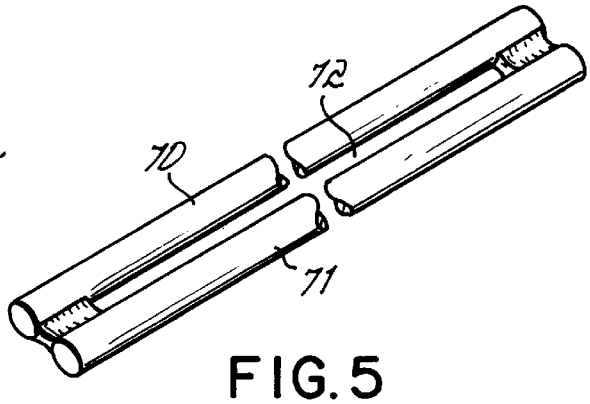
FIG. 5 is a perspective view of the gravity squeeze bars used in the invention.

These rods define a slit or opening 72 (FIG. 5) therebetween which is at least equal to the width of the bag sides plus a small additional amount. The rods as shown in the figures are spaced further apart than is necessary for purposes of clarity only. These pairs of rods or so-called "squeeze rods" are simply placed over the bag and moved downwardly toward the fitment. The end portion 63 of the bag is then secured on a hanger and the bag is suspended.

As the cheese is dispensed, the relatively heavy rods are drawn downwardly under the influence of gravity and thereby pinch the bag sides toward each other. This expresses any cheese in that portion of the bag engaged by the rod downwardly and toward the outlet. This function serves to push the cheese downwardly toward the outlet and to reduce substantially any cheese left in the bag during the dispensing operation.

Turning now back to FIG. 1, it will be appreciated that the hose 35 is provided at its upstream end with a cap or stopper 75 which has an opening for the hose therein and which has internal threads, not shown, for connecting the hose operably to the outlet fitment 62 of the bag 61.

In use, the baffle 26 is provided with an aperture or slot therein permitting the hose and the cap 75 to be raised upwardly through the baffle. The bag can then be lowered into the steam tank 12, where the stopper cap 75 is screwed onto the fitment. Thereafter, the squeeze bar pair 68, 69 or 70, 71 are fitted over the bag portion 63 and the portion 63 is secured to one of the hangers 64, 65 or otherwise rolled around a rod or captured and suspended above the chamber 12.

In use, the steam tank 12 is filled with water up to a point just below the pipe 37 outlet from the tank. The bag is connected as described above and supported in the tank with the bag corners being supported by the baffle surfaces 27, 28.

Thereafter, the heater strip 15 is energized to heat the water for the generation of steam which flows upwardly, surrounds and heats the bag. It has been found that the utilization of steam heat at a high temperature does not tend to scorch the bag but, rather, the bag is protected by the temperature of the cheese or viscous food therein.

The steam quickly heats the bag and the food therein to a desired temperature. Where the bag has been previously opened and then refrigerated for storage for reuse, the steam is sufficient to heat the contents of the bag to a temperature of approximately 160° F.

Thereafter the strip heaters, which can be operated by a timer (not shown), or by some other control in conjunction with a thermostat 77, are either cut off or are reduced in temperature, allowing the water temperature to decrease and the cheese in the bag to decrease to a serving temperature of preferably between 140° and 150° F.

This heating and then cooling down the serving temperature process can be accomplished in less than two hours and the server is ready for use to dispense a hot cheese through the dispensing end of the hose 42.

It will be appreciated that since most of the hose is maintained in the area just outside the bottom area of the tank, all cheese in the hose above the pinch point provided by the pinching member 47 will remain relatively heated and the cheese therein maintained as serving temperature.

When the contents of the bag 61 is depleted, it is only necessary to lift the used bag 61 out of the steam tank, pulling the hose upwardly, there being enough slack left in the hose 35 to allow this to occur. The stopper cap 75 is then removed from the bag and a new fresh bag 60 is replaced.

If the contents of the bag have not been fully depleted at the end of the dispensing operation, then the original closure can be put on the bag and the bag stored in a refrigerator for use at a later time. Upon reuse, thermalization, as described above, where the cheese temperature is raised to at least 160° and then reduced to serving temperature is required. Otherwise, if the cheese is first supplied at room temperature, it is only necessary to raise the cheese to a certain temperature and then begin the dispensing.

As shown in FIG. 2, it will be appreciated that only bag 61 is connected to the dispensing hose 35. Bag 60, on the other hand, is simply maintained in the steam environment for heating, so that when bag 61 is depleted, bag 60 can be immediately connected to the hose 35 and hot cheese can be immediately dispensed without waiting for another warm up period.

In the alternative and for higher volume applications, of course, two bags could be connected into the hose 35 by means of an appropriate "Y" connection and cheese dispensed from both bags at the same time, each being provided with a squeezing pair of rods, such as 68, 69 shown with respect to bag 60 or 70, 71 shown with bag 61.

If a bag 60 is merely hung in the tank 12 for preheating, it may still be desirable to use a squeeze pair of rods, such as rods 68, 69, as shown, in order to preliminarily express cheese into or toward the fitment outlet area of the bag.

The invention thus provides an advantageous apparatus and method for dispensing cheese or viscous food stuffs, for example, from flexible bags where the dispensing operation is generated by the heating of the bags and thereafter the dispensing is under the control of gravity and a pinch off iron udder clamp. No pump is required. In addition, not much water is required, but only enough to generate sufficient steam to initially heat the bag and thereafter maintain the bag and its contents at appropriate serving temperature, so that the bag itself is not required to be immersed in hot water.

The drain 13 of course can be utilized to drain water for replenishment of fresh water between operational cycles.

These and other advantages and modifications will become readily apparent to those of ordinary skill in the art without departing from the scope of the invention and the applicant intends to be bound only by the claims appended hereto:

What is claimed is:

1. A cheese server for warming and dispensing cheese from flexible cheese containing bags and, said server comprising:

means for hanging at least one of the flexible cheese containing bags from a portion of the bag opposite a bag outlet;

means for expressing cheese in the bag toward said bag outlet, said means including a pair of squeeze rods defining a bag receiving opening therebetween, said rods for disposition on said one cheese containing bag so that each rod contacts a side of said bag and squeezes it toward an opposite side of the bag to express cheese from an upper end of the hung bag toward the bag outlet;

means connected to said outlet for dispensing cheese; and means for steam heating cheese in said bags to raise the temperature thereof to a predetermined serving temperature.

2. A cheese server for warming and dispensing cheese from flexible cheese bags and comprising:

a steam tank;

a hanger for hanging at least one of said flexible cheese bags in said tank, said bag having an outlet disposed at a lowest portion of the hung bag;

a hose for connection to said outlet for dispensing the cheese;

means for generating steam to warm cheese in said bag to a serving temperature; and means for squeezing cheese from said one bag, said means including a pair of squeeze rods defining a bag receiving opening therebetween, said rods for disposition on said one cheese containing bag so that each rod contacts a side of said bag and squeezes it toward an opposite side of the bag to express cheese from an upper end of the hung bag toward the bag outlet.

3. A server as in claim 2 including an opening in said steam tank, a hose receiving fitting extending through said opening for and defining a hose outlet from said tank, said fitting sealing said opening against egress of steam from said tank around said hose.

4. A server as in claim 2 wherein said hanger comprises an elongated member and further including a locking element for locking a portion of said bag on said hanger.

5. A server as in claim 4 wherein said elongated member comprises a "C"-shaped channel and said locking element includes a rod for insertion between a portion of the bag within said channel for wedging said bag against the channel and locking the bag in place so the bag can be supported by the channel.

6. A server as in claim 2 further including a baffle in said tank, said baffle having inclined sides for engaging corners of the bag and pushing said corners and any cheese therein toward the outlet of the bag.

7. A server as in claim 2 including a clamp for selectively pinching and opening said hose to dispense warm cheese from said bag, said clamp comprising a pinching member and a weight member attached to said pinching member for pinching off said hose.

8. A server as in claim 2 further including a cabinet surrounding said tank, said tank having a condensate trough about its upper periphery and said cabinet having side panels with upper edges thereof disposed in said trough.

9. A server as in claim 8 further including a removable tank cover having peripheral edges for seating in said trough.

10. A method of warming and dispensing viscous food from flexible bags including the steps of:

hanging a food-filled bag with an outlet disposed at the bottom of the bag, heating the bag contents to a serving temperature by directing steam onto said bag, squeezing bag sides together to express food therebetween toward said outlet by pinching said bag sides together between a pair of rods under the influence of gravity; and dispensing food from a tube operably connected to said outlet.

11. A method as in claim 1 further including the step of urging corners of said bag inwardly toward said outlet.

12. A method as in claim 10 wherein said hanging step includes capturing a portion of said bag opposite said outlet on a hanger and suspending said bag from said hanger in a steam chamber.

13. A method of heating and dispensing cheese from a flexible cheese-filled bag including the step of:

hanging said bag in a steam chamber;

heating the cheese in the bag by exposing the bag to steam in the chamber;

squeezing the hung bag sides together from the upper region thereof by inserting an upper region of the bag between two squeeze bars and suspending the bag so the bars move downwardly by gravity, squeezing the bag sides toward each other; and dispensing heated cheese from the bag.

14. A method of dispensing cheese from a flexible bag having an upper portion and a lower portion defining a bag outlet, said method including the step of:

engaging sides of the bag with respective squeeze bars;

suspending the bag in a chamber;

heating the cheese in the bag by exposing the bag to steam in the chamber;

whereby said squeeze bars hang on the bag and slide downwardly under the influence of gravity to squeeze the sides of the bag toward each other.

* * * * *

UNITED STATES PATENT AND TRADEMARK OFFICE

CERTIFICATE OF CORRECTION

PATENT NO. : 5,833,120
DATED : November 10, 1998
INVENTOR(S) : John C. Evans et al.

It is certified that error appears in the above-identified patent and that said Letters Patent is hereby corrected as shown below:

Column 1,
Line 19, between the terms "up" and "this" insert the word -- to --.

Column 2,
Line 34, delete the word "sidwview" and insert therefor the term -- sideview --.

Column 3,
Line 59, delete the term "TC" and insert therefore the term -- C --.

Column 4,
Line 67, delete the term "as" and insert therefore the term -- at --.

Claim 11,
Line 1, delete the number "1" and insert the number -- 10 -- therefor.

Signed and Sealed this

Eighteenth Day of September, 2001

*Attest:*

Nicholas P. Godici

*Attesting Officer*

NICHOLAS P. GODICI
*Acting Director of the United States Patent and Trademark Office*